United States Patent [19]

Ban et al.

[11] Patent Number: 4,678,365

[45] Date of Patent: Jul. 7, 1987

[54] MATERIAL SPREADER

[75] Inventors: Thomas R. Ban, Redondo Beach; Ernest E. Dusterhoft, Culver City; John E. Gilmore, Los Angeles, all of Calif.

[73] Assignee: Tricon Industries, Los Angeles, Calif.

[21] Appl. No.: 822,276

[22] Filed: Jan. 24, 1986

[51] Int. Cl.[4] ..... E01C 19/22

[52] U.S. Cl. ..... 404/118; 404/101; 404/104

[58] Field of Search ..... 404/84, 96, 98, 101, 404/104–106, 108, 110, 118, 119

[56] References Cited

U.S. PATENT DOCUMENTS

| | | | |
|---|---|---|---|
| 2,510,523 | 6/1950 | Schiavi | 404/119 X |
| 3,557,672 | 1/1971 | Schurtz | 404/118 X |
| 3,572,227 | 3/1971 | Poulsen | 404/118 X |
| 3,791,753 | 2/1974 | Rymsa | 404/84 |
| 3,874,807 | 4/1975 | Puckett et al. | 404/110 |
| 3,901,618 | 8/1975 | Sant' Agata | 404/118 |
| 3,907,451 | 9/1975 | Fisher et al. | 404/118 X |
| 3,914,064 | 10/1975 | Gurries | 404/84 |
| 3,992,124 | 11/1976 | Schrader | 404/118 |
| 4,129,399 | 12/1978 | Ruge | 404/104 X |
| 4,272,213 | 6/1981 | McGovarin | 404/104 X |
| 4,320,988 | 3/1982 | Seal | 404/118 |
| 4,345,852 | 8/1982 | Goto et al. | 404/104 X |
| 4,379,653 | 4/1983 | Brown | 404/104 X |
| 4,395,156 | 7/1983 | Sprague, III | 404/110 |

FOREIGN PATENT DOCUMENTS

| | | | |
|---|---|---|---|
| 109639 | 5/1984 | European Pat. Off. | 404/101 |
| 1492776 | 11/1977 | United Kingdom | 404/118 |

*Primary Examiner*—Stephen J. Novosad
*Assistant Examiner*—John F. Letchford
*Attorney, Agent, or Firm*—Michael J. Ram

[57] ABSTRACT

A device for spreading asphalt and other road paving materials is disclosed. The spreader comprises a main body, two separately adjustable wings and various end components to adapt the spreader to different road surfaces, tasks or operator preferences. Structural rigidity and strength results from the use of a three point hitch and a combination of three horizontal, longitudinally position pipes in the main body and three like positioned pipes attached to the wings, said pipes moving coaxially within the main body pipes.

5 Claims, 14 Drawing Figures

MATERIAL SPREADER

BACKGROUND OF THE INVENTION

The invention relates to improvements in devices for preparing the road bed and for laying down and grading road surfacing materials, particularly gravel and asphalt in a controlled but readily adjustable manner.

THE PRIOR ART

The prior art has many references to asphalt spreaders that are an integral part of a motor driven, self propelled device (U.S. Pat. Nos. 4,304,504; 4,215,949; 3,874,807 and 3,820,913). Additional references show blade devices mounted on wheeled or tracked vehicles or spreading apparatus may be on the vehicle and part is towed behind the vehicle (U.S. Pat. Nos. 3,820,914; 3,884,395; 4,022,386; 4,068,969; 4,102,590; 4,395,156).

Spreader units capable of working in smaller spaces or more adaptable for paving small areas have been designed to be towed by tractors or skiploaders. Generally these units can properly function when towed only in a forward direction. Paving depth and pavement slope is usually varied by manual adjustment of threaded rods or the movement of nuts and bolts. As can be expected these devices give only a limited capability to adjust the variables in the pavement laydown process. Also, because of the nature of the materials being worked with these bolts, nuts and threaded rods are readily fouled making adjustment difficult and time consuming.

Typically, threaded rods attached to hand cranks are used to adjust the position and height of the outer edge cutting blades. Alternatively, these blades or attachments for forming a gutter and curb may be mounted on the spreader blade using nuts and bolts. Various techniques have been utilized to control the paving depth. Usually this is accomplished by manually positioning the height of the blade in relation to skis, rollers or wheels mounted at the outer most ends of the spreader blades.

The prior art devices all have substantial drawbacks and deficiencies. The integral or truck drawn structures can not be used in confined spaces, are not readily adaptable to doing small jobs and, particularly in the case of self contained units, are difficult to transport between jobs. Many towed paving systems are too light to give a consistent, high quality pavement, and because they are designed to be readily transportable, are light weight and thus subject to fluttering, inconsistent control of paving depth or, in the worst cases, binding under heavy paving loads. These devices can be adjusted during the paving operation only by stopping the equipment and manually changing the depth or width of the asphalt laydown. In addition, these devices do not allow operation in either a forward or reverse direction. U.S. Pat. No. 3,901,618 to Sant'Agata shows an improvement to tractor towed asphalt spreading devices. Hydraulics have been added in the place of the adjustable threaded rods thus allowing the continuous adjustment of the paving depth and spread width. This can be controlled by a single operator sitting in the tractor driver seat. However, the blades do not appear to be individually adjustable. Secondly, the unit does not have the flexibility of interchangeable end components. U.S. Pat. No. 3,680,451, while still requiring adjustment of bolts to change the paving angle of a slope forming attachment, shows an early application of hydraulics in conjunction with a threaded bar to move the sloping attachment in a horizontal manner. U.S. Pat. No. 2,510,523 shows the use of side rollers to control the paving depth of a road grade. U.S. Pat. Nos. 2,962,949; 4,415,173 and 3,572,227 show different means for increasing the width of a screed in a paving operation.

OBJECTS AND SUMMARY OF THE INVENTION

It is the object of the invention to provide novel improvements to vehicle drawn paving devices.

It is a further object to provide a vehicle drawn paving machine with strength and rigidity superior to the devices previously available.

It is a still further object to provide a device more easily controlled, modified and adjusted than devices previously available.

The device of the invention has several structural improvements which increase its strength and rigidity and thus the operators ability to lay down a highly consistent road surface. In addition, the several operator controlled, hydraulically operated adjustments allow frequent and continual variation of the paving equipment variables including spread width, paving depth and side to side tilt. The apparatus can be operated in either a forward or reverse direction, can be angled inward and outward and can be used to grade a surface, spread gravel or stone and then apply an asphalt pavement. The apparatus is readily adapted so that different attachments can be added to suit particular requirements of the job.

More particularly, the invention comprises a main body with a three point towing hitch attached thereto, two expandable wings moveably mounted on the main body and several different interchangeable end arrangements mounted on the free ends of the wings. Rigidity is obtained by the use of three triangularly positioned pipes extending through the main body and elongated runner pipes mounted in the wings which fit coaxially within the main body pipes. All the adjustments to the grader are made through the use of hydraulic drives mounted within the grader which are connected to the hydraulic system of the towing vehicle so that they can be manipulated by the operator while the spreading operation is in progress. Interchangeable end arrangements include skis, side rollers, spreader box sides and combinations thereof.

DETAILED DESCRIPTION OF THE INVENTION

Figure 1:
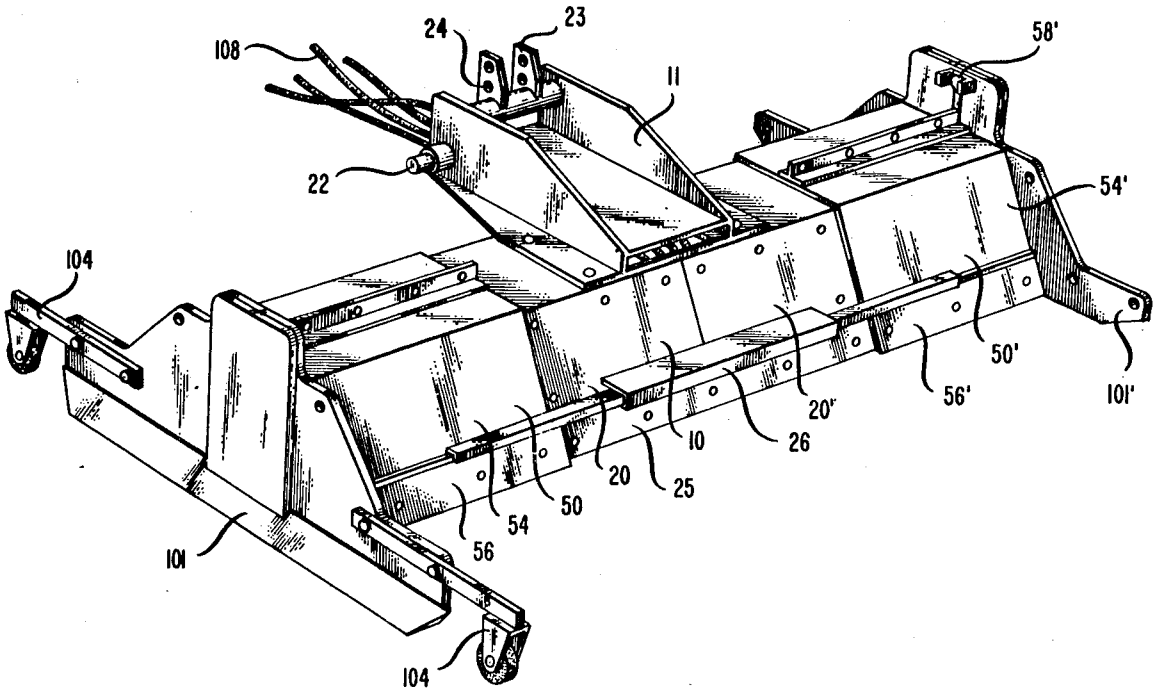
FIG. 1 is a perspective view of the rear of the spreader equiped with a ski on one end to ride on the finished surface and a ski with wheels on the other end to ride on the graded surface.
Figure 2:
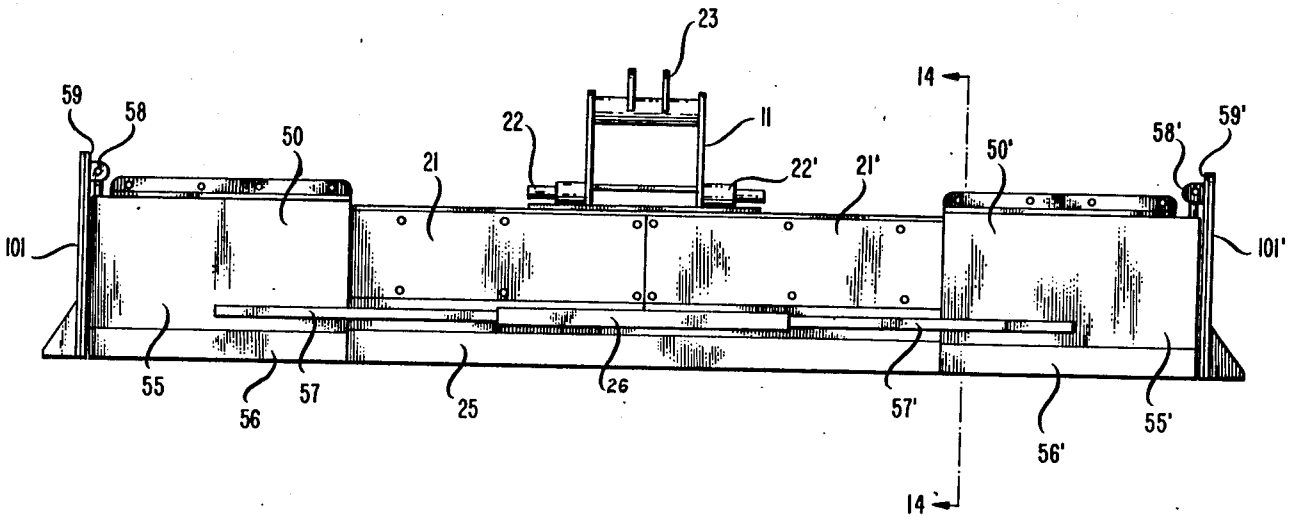
FIG. 2 is a rear view of the spreader of FIG. 1 equiped with two side skis.

Referring to FIGS. 1-7, the spreader of the invention is assembled from several components including a main body 10, a three point hitch 11 rigidly mounted on the main body 10 by bolts or welding, wings 50 slideably mounted on the main body 10 and side pieces such as skis 101, a side roller 102 or spreader box sides 103.

Figure 8:
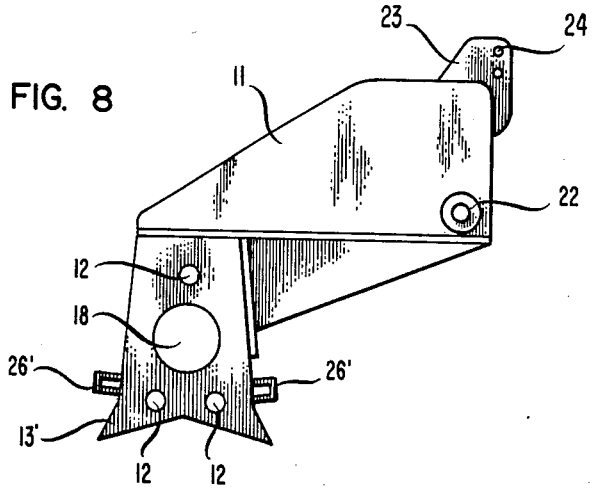
FIG. 8 is an end view taken along line 8—8 of FIG. 3 of the main body and three point hitch.

The main body 10 has mounted longitudinally through its center three guide pipes 12 in a triangular configuration best seen from the side in FIG. 8. These pipes are welded to the ends 13, 13' of the main body as well as at least two internal supports 14, 14' within the main body 10. The triangular design assures the strength and rigidity of the structure and provides an acceptable balance of forces within the device when operated in either a forward or reverse direction. Mounted horizontally within the main body 10 are two hydraulic cylinders 15. Preferably, one end of each of the cylinders 15 is mounted utilizing a pivot 16, 16' to one of the internal supports 14, 14' while the piston 17, 17' of the cylinder 15, 15' passes through hole 18, 18' in the main body end 13, 13' for connection to the wing. The cylinders 15, 15' are utilized to control expansion of the width of the spreader. The main body 10 is covered by a skin 20 on its front surface and removable access panels 21 on its rear surface. These removable panels 21 allow the hydraulic cylinders 15 to be accessed for maintenance.

Securely mounted by bolting and/or welding, to the top of the main body 10 is a three point hitch 11 assembled from several triangular pieces to maximize its strength and to prevent bending of the structure. The hitch 11 has two pins 22, 22' positioned on opposite sides of the forward end of the hitch 11 at the same horizontal level and an elevated center bracket 23 positioned vertically above and between the pins 22, 22', said bracket 23 having mounting holes 24 therein for the placement of towing pins (not shown). The two pins 22, 22' are fastened to the hitch 11 in such a manner that they can be easily replaced should they get bent or broken. Usually such towing pins have to be cut and new pins welded into place.

Two heavy duty cutting blades 25 are removably mounted across the bottom of the front and rear of the main body 10. Each of these blades 25 covers the entire width of the main body 10. As a result of the triangular cross-sectional shape of the main body 10 the bottom of the blades 25 are further apart than the top of the blades thus making it possible for the spreader of the invention to operate in either a forward or reverse direction.

Also attached to the front and rear of the main body 10 are lower body stabilizing guides 26 which assist in stabilizing the assembled device.

Figure 3:
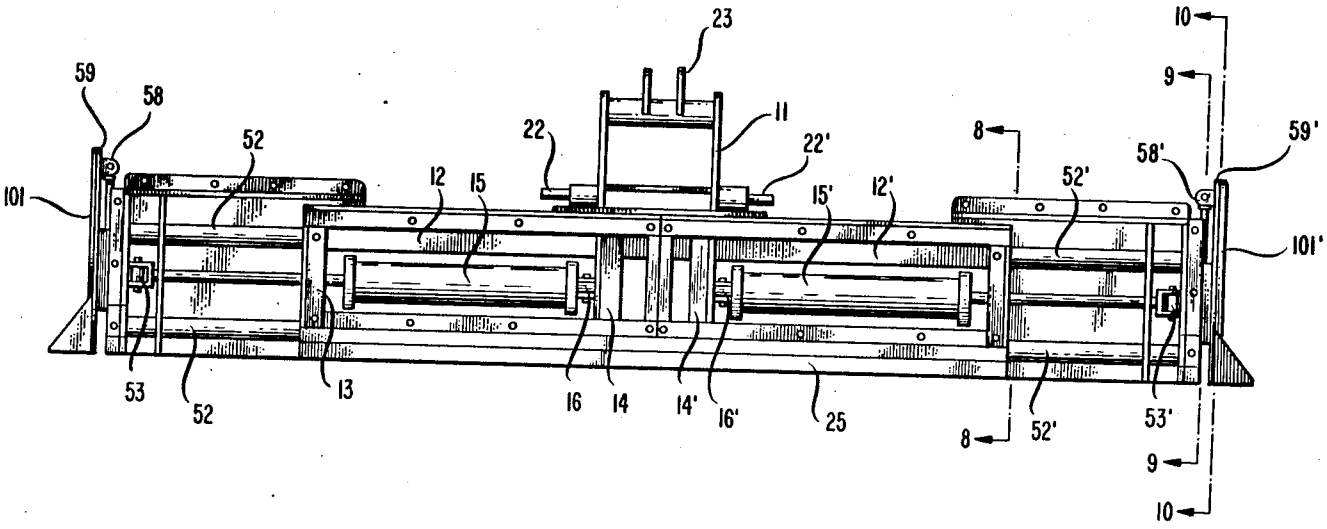
FIG. 3 is a second rear view of the spreader of FIG. 2 with several of the access panels removed to reveal the hydraulic drives for the wings.
Figure 4:
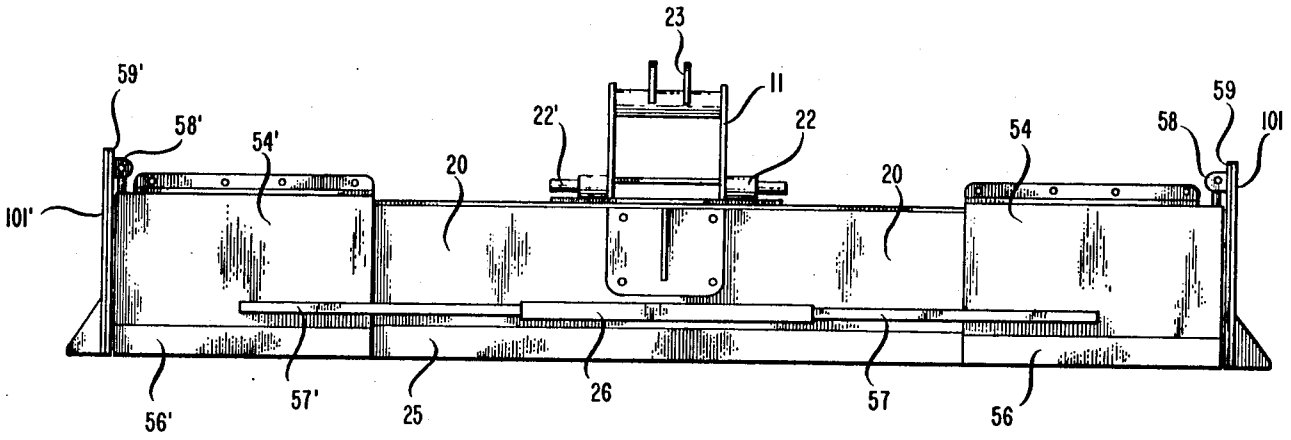
FIG. 4 is a front view of the assembly of FIG. 2.
Figure 5:
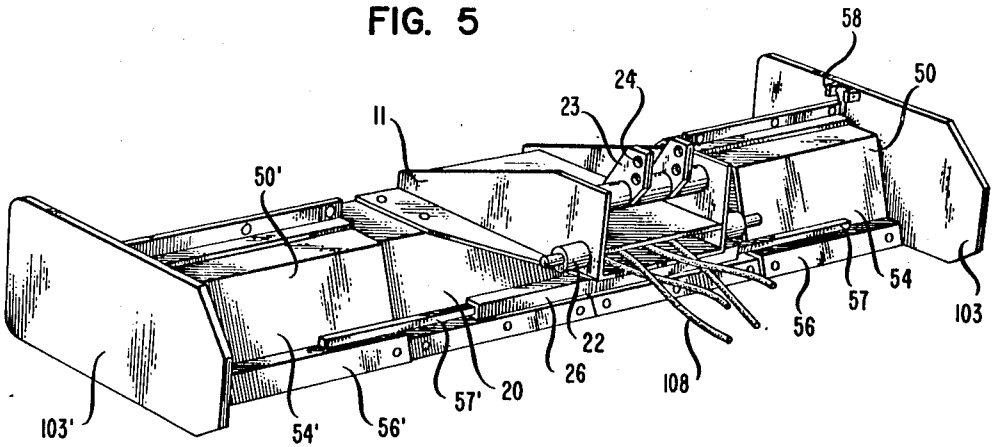
FIG. 5 is a perspective view of the front of the spreader equiped with two spreader box sides.
Figure 6:
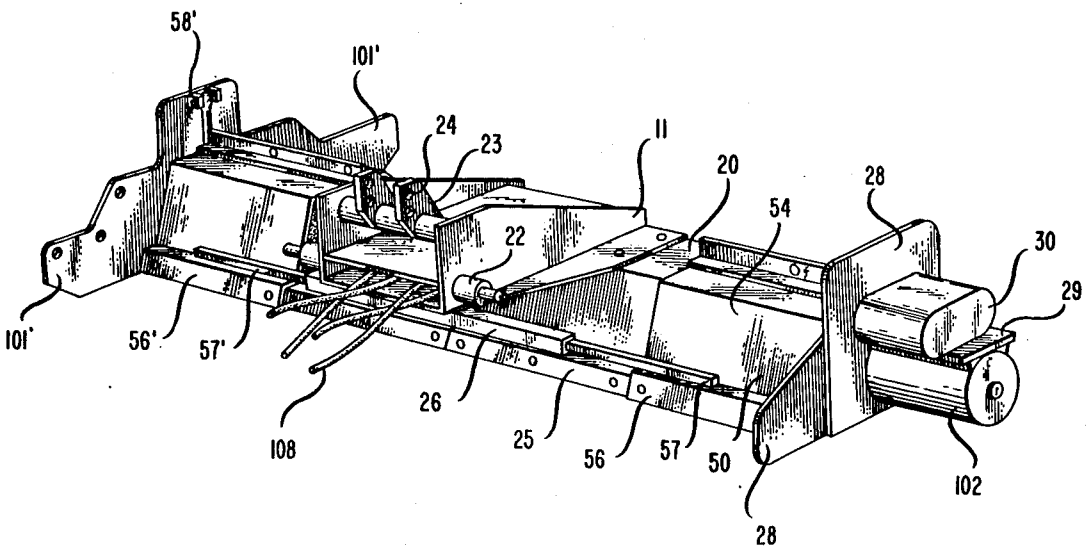
FIG. 6 is an additional perspective view of the front of the spreader of FIG. 5 equiped with one ski and one roller.
Figure 7:
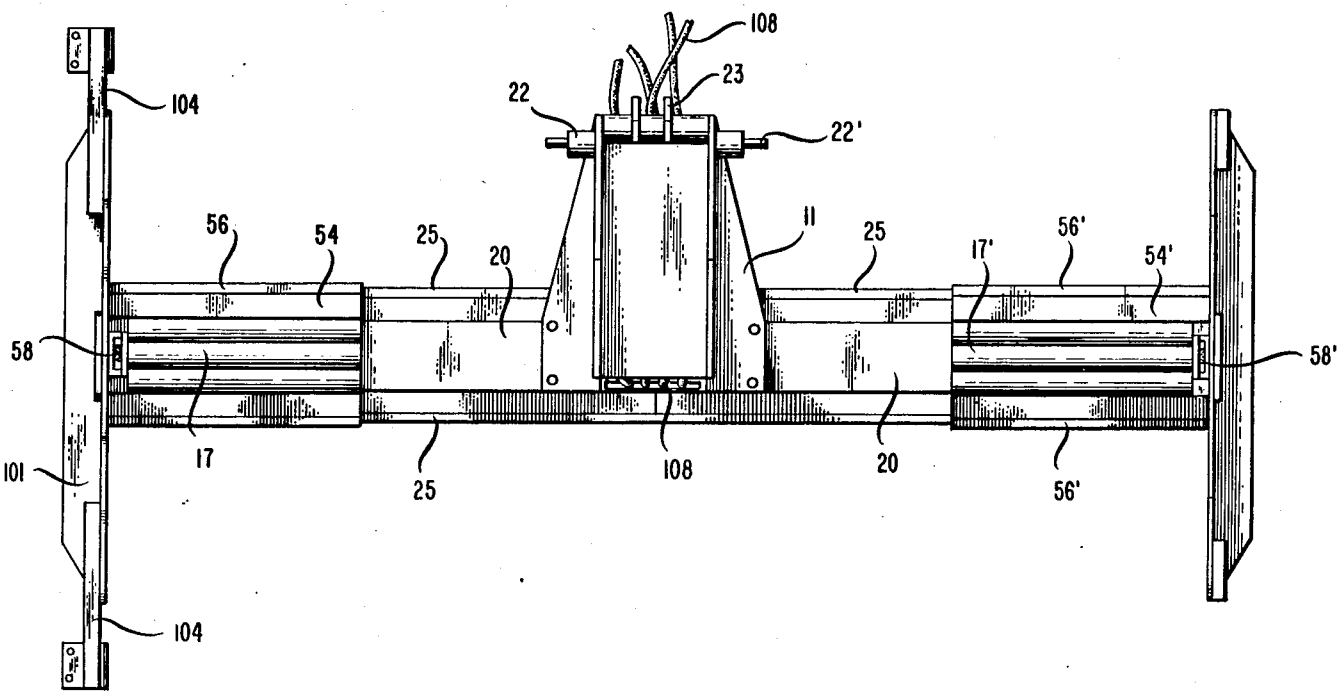
FIG. 7 is a top view of the spreader of FIG. 1.
Figure 12:
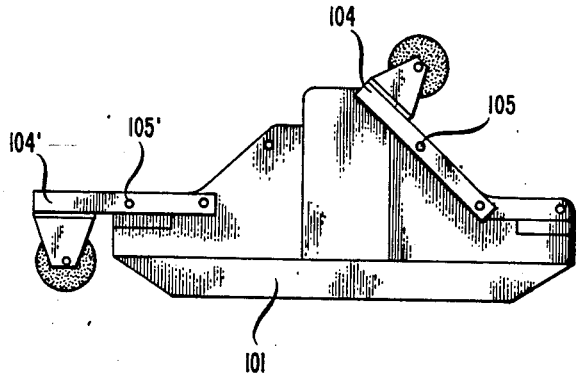
Figure 13:
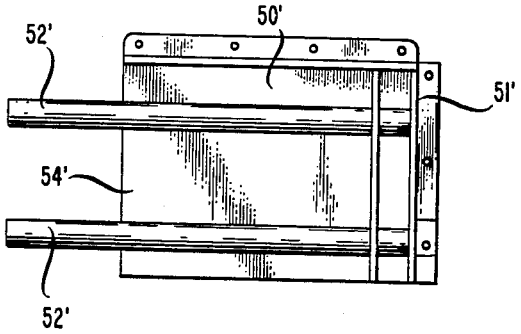
FIG. 13, is a side view of the right wing assembly with the access panel removed, the assembly shown separated from the main body.

Moveably attached to the main body 10 are a left and right wing section 50, 50'. These wing sections 50, 50' can be independently operated to increase the width of the spreader. Referring particularly to FIGS. 3, 7, and 12, permanently secured to the wing frame 51, 51' are three wing runner pipes 52, 52' arranged in the same triangular configuration as the main body pipes 12. The diameter of the runner pipes 52, 52' are chosen so that they fit coaxially within the guide pipes 12 and have a length such that the internal end of the runner pipe 52, 52' remains within the guide pipe 12 when the wings are moved to their maximum useful width expansion. Left and right pistons 17, 17' of hydraulic cylinders 15, 15' are connected to the left and right wing frames 51, 51' by left and right hydraulic cylinder mounts 53, 53' mounted on the inner surface of the wing frames 51, 51'.

Figure 9:
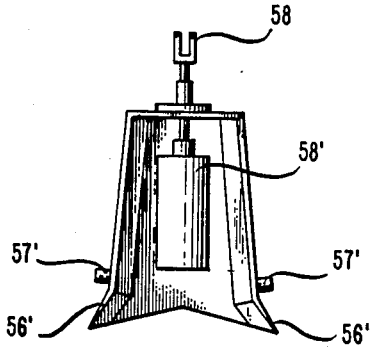
FIG. 9 is an end view taken along line 9—9 of FIG. 3 of the right wing with the guide plate removed to show the height adjusting hydraulics.
Figure 10:
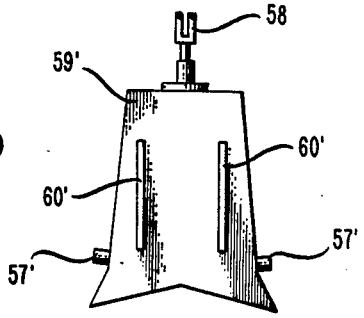
FIG. 10 is a second end view taken along line 10—10 of FIG. 3 of the right wing with the guide plate in place showing the means for mounting the end component.

Vertically mounted on the outer surface of the wing frames 51, 51' are left and right height adjusting hydraulic cylinders 58, 58' (see FIG. 9). The mounting portion of hydraulic piston 58, 58' extend above guide plates 59, 59' and are attached to components such as skis mounted on the guide plate 59, 59'. The guide plates 59, 59' are affixed to the end of wing frame 51, 51' enclosing the hydraulic cylinders 58, 58' between the wing frame 51, 51' and the guide plates 59, 59'. On the outer surface of the guide plates are means for moveable mounting, in a stable manner, components to be added to the end of the wings. FIG. 10 shows, as means for mounting the components, grooved bars 60' which are half of a tongue and groove arrangement, the other half being a part of the component to be added. Other examples of moveable mounting means would include coaxial pipes and overlapping flanges.

Figure 14:
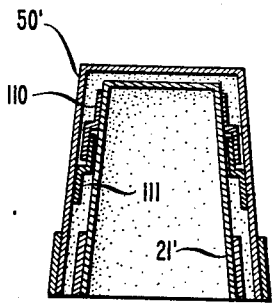
FIG. 14 is a side view taken along line 14—14 of FIG. 2 of the right assembly and access panel wherein an alternate stabilizer system is used. de

The wings 50, 50', in a manner similiar to the main body 10, are covered by a skin 54, 54' on the front surface and access panels 55, 55' on the rear surface. Heavy duty cutting blades 56, 56' are removably attached to both the front and rear of the wing bottoms and mounted above the blades 56, 56' are stabilizer bars 57, 57' positioned to ride within the body stabilizer guides 26. FIG. 14 shows an alternative stabilization system wherein stabilizer guide 26 is replaced by downwardly open tongue 110 which interacts with upwardly open tongues 111, 111' which is mounted on the inside of access panel 27, 27' rather than the externally mounted stabilizer bar 57, 57'.

Figure 11:
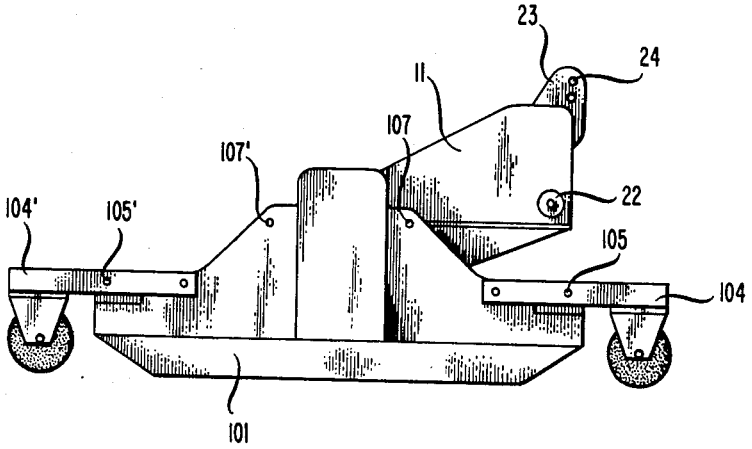
FIGS. 11 and 12 are side views showing the ski with wheels, FIG. 12 showing one wheel in its retracted position.

Various different side components can be removeably mounted to the right and left guide plates 59, 59' and mounting portion of hydraulic piston 58, 58' depending on the desired function of the spreader, the preference of the operator or the requirements of the terrain and roadbed. FIG. 1 shows the spreader with a ski 101' attached to the right guide plate 59' and a ski 101 with wheel, brackets; 104 attached to the left guide plate 59. FIGS. 11 and 12 show a right side ski 101' with the wheel bracket 104 in both the down and up position.

To change the wheel bracket 104 position a locking pin 105 is removed from the bracket 104 and the set hole 106, the wheel bracket 104 is pivoted to an upright position and the pin is reinserted into the bracket 104 and ski at the transport hole 107 location. The side skis 101 guide and control the amount of material being spread and cut. Generally, the ski 101 is adjusted to ride on the newly paved surface while the ski 101 with wheel bracket 104 will ride on the underlying graded surface.

The side roller 102 may be utilized in place of one of the skis 101 in which case it is usually set to run on the finished surface. If the skis 101 are replaced by the spreader box sides 103 the spreader unit can be utilized to spread dirt, stone or gravel.

While at least one prior art device has utilized the hydraulic system of the towing vehicle to adjust the spreader, the present invention has much greater utility and versatility. The towing vehicle hydraulic system is utilized but additional hydraulic controls (not shown) are added to the towing vehicle. These controls are connected through hydraulic lines 108 to the main body hydraulic cylinders 15, 15' and the height adjusting hydraulic cylinders 58, 58'. Each one of the hydraulic cylinders 15, 15', 58, and 58' can be individually controlled by the tractor operator without requiring him to leave his seat. Thus, hydraulic cylinders 15 and 15' can be individually activated to move either left or right wing 50, 50' in or out to widen or narrow the area of the spread; it is not necessary to expand each wing the same amount. In this manner the towing tractor can proceed generally down the center of the area and the wings can be individually and continuously moved to adjust to changing widths of the area to be spread or paved. Prior art devices, if expandable sections were provided, required that these sections be expanded equally. In addition, the adjustments to effect expansion usually required the operator to dismount from the tow vehicle and manually make adjustments. In a like manner the height adjusting hydraulic cylinders 58, 58' are utilized to individually and continuously adjust the height above the surface of the left and right ends of the spreader. For example, the ski riding on the newly paved surface would be adjusted with the hydraulic cylinder 58 so that the cutting blade 56, 56' at that point is at the new surface level. The ski 101 with wheel bracket 104 is hydraulically adjusted so that the cutting blade 56 is above the grade level an amount equal to the desired new pavement thickness. This adjustment can be made by the operator from his seat while the spreading operation is proceeding thus resulting in a smooth and uniform paved surface.

The invention contemplates the use of various different side pieces, other than those described, which are designed to suit the particular tasks or operator preferences. The utility of the invention as to this feature is that a system is made available to which modified components can be readily attached. The invention further includes the addition of servo systems utilizing sensors to continuously monitor the paving depth, said servo system being directly connected to the hydraulic controls for continuous adjustment without the intervention of the operator. In addition, servo systems can also be utilized to control the paving width and to assure that the towing vehicle and spreader are proceeding over the path to be paved as required by the engineering specifications.

We claim:

1. A spreader apparatus to be towed by a traction device comprising:

a main body section having forward and rear blade surfaces, at least three pipes longitudinally mounted in a horizontal manner within the main body, two wings moveably mounted over said main body section, said wings having forward and rear blade surfaces, at least three pipes longitudinally mounted in a horizontal manner within each of said wings, said pipes positioned to slide coaxially within the main body pipes when the wings are mounted on the main body, two independently operable hydraulic cylinders mounted within the main body and wings with one end of each hydraulic cylinder attached to the main body and the other end of each hydraulic cylinder attached to each wing, said hydraulic cylinders connected to a system to operatively move the wings across the outer surface of the main body, a second set of independently operable hydraulic cylinders each vertically mounted at the outer end of each of the wings, end components moveably mounted to the outer ends of the wings and then secured to the tops of the vertically mounted hydraulic cylinders, said components moveable in a vertical direction, said second set of hydraulic cylinders connected to a system to operatively move the end components in a vertical direction.

2. The spreader of claim 1 wherein the main body pipes are arranged in a triangular configuration.

3. The spreader of claim 1 wherein the end components are chosen from the group consisting of skis, side rollers and spreder box sides.

4. The spreader of claim 3 wherein the skis have wheels attached thereto.

5. The spreader of claim 1 having a three point hitch securely mounted to the front top thereof.

* * * * *